US005091223A

United States Patent [19]

Mori et al.

[11] Patent Number: 5,091,223

[45] Date of Patent: Feb. 25, 1992

[54] PROCESS FOR FORMING A BLACKENED LAYER ON A ZINCIFEROUS SURFACE BY CONTACTING THE SURFACE WITH AN AQUEOUS SOLUTION CONTAINING NICKEL AND COBALT IONS

[75] Inventors: Kazuhiko Mori; Toshi Miyawaki; Hitoshi Ishii, all of Kanagawa, Japan

[73] Assignee: Henkel Corporation, Ambler, Pa.

[21] Appl. No.: 544,455

[22] Filed: Jun. 27, 1990

[30] Foreign Application Priority Data

Jun. 27, 1989 [JP] Japan ..... 1-164619

[51] Int. Cl.[5] ..... B05D 3/02

[52] U.S. Cl. ..... 427/383.7; 427/427; 427/428; 427/429; 427/436

[58] Field of Search ..... 427/436, 437, 383.7, 427/427, 428, 429

[56] References Cited

U.S. PATENT DOCUMENTS

| | | | |
|---|---|---|---|
| 3,147,154 | 9/1964 | Cole et al. | 427/437 |
| 3,403,035 | 9/1968 | Schneble, Jr. | 427/437 |
| 3,444,007 | 5/1969 | Maurer | 148/6.15 |
| 3,597,267 | 8/1971 | Mallory, Jr. et al. | 427/437 |
| 3,876,434 | 4/1975 | Dutkewych et al. | 427/437 |
| 4,880,476 | 11/1989 | Matsuda et al. | 148/253 |
| 4,904,544 | 2/1990 | Mori et al. | 428/658 |

FOREIGN PATENT DOCUMENTS 0356756 8/1989 European Pat. Off. .

*Primary Examiner*—Shrive Beck
*Assistant Examiner*—Benjamin L. Utech
*Attorney, Agent, or Firm*—Ernest G. Szoke; Wayne C. Jaeschke; Norvell E. Wisdom, Jr.

[57] ABSTRACT

Zinciferous surfaces, particularly those of galvanized steel, may be effectively coated with an adherent corrosion resistant black layer of fine metal particles by contacting the surfaces with an aqueous solution containing (A) at least 0.5 g/L of the treatment solution of $Ni^{2+}$ and/or $Co^{2+}$ ions; and (B) an amount, sufficient to complex all the ions of component (A), of a weak complexing component selected from the group consisting of ammonia, saturated aliphatic compounds having at least two amino groups of which at least one is a primary amino group, and/or amino acids; and, optionally but preferably, (C) at least 50 parts per million ("ppm") by weight of a component selected from the group consisting of nitrite ions, nitrate ions, carbonate ions, thiocyanate ions, thiosulfate ions, thiourea, hypophosphite ions, phosphite ions, and/or perchlorate ions.

20 Claims, No Drawings

PROCESS FOR FORMING A BLACKENED LAYER ON A ZINCIFEROUS SURFACE BY CONTACTING THE SURFACE WITH AN AQUEOUS SOLUTION CONTAINING NICKEL AND COBALT IONS

FIELD OF THE INVENTION

This invention relates to a treatment method for blackening surfaces consisting predominantly of zinc, including galvanized steel or other zinc coated base metal material, made by electrogalvanization, zinc-alloy electroplating, hot-dip galvanizing, and the like. The method finds use in optical instruments, solar-energy absorbing panels, and any other applications which require a black, corrosion-resistant coating on a object with a zinciferous surface, i.e., one consisting predominantly of zinc. Unless the context requires otherwise, the term "zinc" hereinafter shall be understood to include both pure zinc and zinc alloys that are predominantly zinc and to include surface coatings as well as solid objects with a surface the same as the interior.

STATEMENT OF RELATED ART

Various methods are known for blackening zinc and galvanized material by chemical treatment. An example of this art is the blackening treatment method disclosed in Japanese Pat. application Laid Open [Kokai] Number 61-253381 [253,381/86]. This blackening treatment method employs an acidic aqueous solution, with a pH of 1.5 to 4, which contains an oxidizer, at least gram per liter ("g/L") of $Cu^{+2}$ ions, and 1 to 30 weight %, referred to the $Cu^{+2}$ ions, of $Ni^{+2}$ ions. This solution is applied at a liquid temperature of 20 to 70 degrees Centigrade for 1 to 5 seconds, and because of its acidity, requires a relatively expensive corrosion resistant treatment container.

The black film obtained by this treatment contains Cu and Ni in order to increase the weldability. The Cu, because it accelerates zinc corrosion by forming local galvanic cells with the underlying zinc, degrades the corrosion resistance and also reduces the adherence of the black surface film to the substrate.

It is an object of the present invention to provide a surface blackening treatment for zinc with improved corrosion resistance and adherence to zinc. It is another object of this invention to provide such a treatment from a less corrosive solution than that described immediately above for the same purpose.

DESCRIPTION OF THE INVENTION

In this description, except in the working examples and the claims, or where expressly indicated to the contrary, all numbers specifying amounts of materials or conditions of reaction or use are to be understood as modified by the term "about". Also, it is to be understood that the presence of necessary counterions is implied for any constituent stated herein in ionic terms.

One embodiment of the present invention is a process for forming a blackened layer on a zinc surface by contacting the zinc surface with a treatment solution which has a pH of at least 5 and which comprises, or preferably consists essentially of, water and:

(A) at least 0.5 g/L of the treatment solution of ions selected from the group consisting of $Ni^{2+}$, $Co^{2+}$, and mixtures thereof; and (B) an amount, sufficient to complex all the ions of component (A), of a weak complexing component selected from the group consisting of ammonia, saturated aliphatic compounds having at least two amino groups of which at least one is a primary amino group, amino acids, and mixtures of any two or more of these; and, optionally but preferably, (C) at least 50 parts per million ("ppm") by weight of a component selected from the group consisting of nitrite ions, nitrate ions, carbonate ions, thiocyanate ions, thiosulfate ions, thiourea, hypophosphite ions, phosphite ions, perchlorate ions, and mixtures of any two or more of these.

$Ni^{2+}$ and/or $Co^{2+}$ is preferably added to the treatment solution in the form of the sulfate or chloride. A Ni and Co precipitation sufficient to blacken the surface of zinc or galvanized material can be obtained at concentrations at least 0.5 g/L for the total quantity of $Ni^{2+}$ and/or $Co^{2+}$. Furthermore, roughly the same effects are obtained even when the $Ni^{2+}$ and $Co^{2+}$ concentration is higher than this value.

In addition to $Ni^{2+}$ and/or $Co^{2+}$, another essential component of a treatment solution to be used according to this invention is made up of one or more compounds selected from ammonia, saturated aliphatic compounds having at least two hydrogen-containing amino groups, and amino acids. Specific examples of the compounds having two amino groups of which at least one is a primary amino group are ethylenediamine, trimethylenediamine, N-methylethylenediamine, N-ethylethylenediamine, N-n-propylethylenediamine, N,N-dimethylethylenediamine, 1,2-diaminopropane, meso-2,3-diaminobutane, racemic-2,3-diaminobutane, cis-2,3-diaminocyclohexane, trans-1,2-diaminocyclohexane,-trans-1,2-diaminocycloheptane, diethylenetriamine, and triethylenetetramine. Specific examples of suitable amino acids include alanine, glycine, aspartic acid, and glutamic acid. Any of these materials are added as complexing agents for the nickel and/or cobalt present, and thus must be added in a quantity at least stoichiometrically sufficient to complex all of the nickel and cobalt. For example, for the case of $Ni^{2+}$ and ammonia in aqueous solution, this means that the ammonia must be added at $\geqq$6-fold molar ratio relative to the $Ni^{2+}$ since the nickel-ammonia complex has the formula of $[Ni(NH_3)_6[^{2+}$. Furthermore, roughly the same effect is obtained in the present invention even when the complexing agent is added in quantities larger than the minimum required to complex the and $Ni^{2+}$ and $Co^{2+}$.

The treatment solution of the invention also preferably contains, as an additional component, at least 50 ppm of one or more ions or compounds selected from nitrite ions, nitrate ions, carbonate ions, thiocyanate ions, thiosulfate ions, thiourea, hypophosphite ions, phosphite ions, and perchlorate ions. These compounds, with the exception of thiourea, are usually added in the form of their alkali metal or ammonium salts. Thiourea is added as such. The advantage associated with the presence of these compounds is an acceleration of the tendency of zinc from the surface being treated to dissolve and thereby to accelerate precipitation onto the metal surface of nickel and/or cobalt from the complexes in which these metals are the central metal element. While this increased precipitation rate can be clearly observed after the addition of a total of at least 50 ppm (referred to the treatment solution) of one or more of the aforementioned additive compounds, an excellent precipitation enhancing effect is also obtained with higher concentrations than this. Accordingly, an optimum concentration may be selected based on economic considerations, balancing the higher cost for materials of a higher concentration against the savings in capital cost from faster operation of the process.

Preferably the process is performed in such a manner that from 80 to 200 milligrams per square meter ("mg/m$^2$) of the total of Ni and Co is precipitated on the treated surface during a contact time of preferably from 3 to 120 seconds at a temperature that is preferably between 20 and 80 degrees Centigrade. Contact may be achieved by immersion, spraying, roll coating followed by passage through a squeeze roll, or any other suitable technique or mixture of techniques.

Alternatively, an electrolytic method, in which the treated surface of the workpiece is connected as a cathode to a source of electromotive force during immersion, can be used. In this case, the same quantity of Ni and/or Co as above can be deposited on the surface of the treated workpiece by carrying out electrolysis at a cathode current density of 1 to 100 amperes per square decimeter ("amp/dm$^2$") for 2.0 to 10.0 seconds.

The practice of the invention may be further appreciated from the following, non-limiting, illustrative and comparison examples.

EXAMPLES

General Conditions

All the treatments in the examples and comparison examples were dipping treatments, and, with the exception of Comparison Example 3, the treatment temperature was 40 degrees Centigrade. The treatment temperature in Comparison Example 3 was 30 degrees Centigrade. The $Ni^{2+}$ and $Co^{2+}$ were added in the form of their sulfates; ammonia was added in the form of 28% aqueous ammonia; the other complexing agents were added in the form of the 100% powder or liquid; and the nitrite ion and other anionic additives were added in the form of the sodium salts. Sulfuric acid or sodium hydroxide was used to adjust the pH. Example 7 from Japanese Patent Application Laid Open Number 61-253381 is reported herein as Comparison Example 3.

The evaluations were carried out as follows. The blackness was evaluated based on the L-value (fractional values were rounded to the decimal point) as determined using an SM color computer from Suga Test Instruments Company, Limited. The adherence was evaluated by folding once (usually designated in the art as "1T") and then peeling with transparent adhesive tape, and was scored using the following evaluation standards: ++=no peeling; +=less than 10% peeling; Δ=10 to less than 30% peeling; and x=more than 30% peeling.

The specific treatment conditions and performance evaluations for Examples 1 through 9 and Comparison Examples 1–4 are reported in Table 1.

Discussion of the Evaluation Results

The lower limit for the nickel and/or cobalt concentration is illustrated by a comparison of Example 4 (Co at 0.7 g/L) and Comparison Example 1 (Co at 0.3 g/L). While Comparison Example 1 has an unsatisfactory L-value of 25, Example 4 has a satisfactory blackness with an L-value of 15, thus supporting a lower limit of 0.5 g/L for the total concentration of nickel and cobalt in the treatment solution. The lower limit on the additive concentration is illustrated by a comparison among Examples 1 through 3. Here, Example 2 (additive concentration=0.03 g/L) has the same blackness as Example 1 (no additive), while the blackness is clearly increased in Example 3 (additive concentration=0.07 g/L). This supports a value of 50 ppm (=0.05 g/L) for the preferred lower limit for the additive concentration.

With regard to the treatment time, the L-value in Comparison Example 2 (2 second treatment) exceeds 20, which should be compared with Example 9 (5 second treatment). This supports a preferred lower limit on the treatment time of 3 seconds.

An L-value of 12 was obtained in Comparison Example 3 through blackening with a precipitate other than nickel and cobalt, using a copper containing solution as described in Japanese Pat. application Laid Open Number 61-253382). However, in this case the adherence was poor, so that substantial peeling with transparent adhesive tape was obtained after a 1T fold.

TABLE 1

| | | | | Examples (Treatment Conditions and Properties) | | | | | | | |
|---|---|---|---|---|---|---|---|---|---|---|---|
| | type of plated | metal added | | complexing agent | | additive | | treatment time | | L | |
| number | steel sheet | type | g/L | type | g/L | type | g/L | (seconds) | pH | value | adherence |
| Example 1 | EG | Ni | 5.0 | ethylenediamine | 30 | — | — | 20 | 7.5 | 18 | ++ |
| Example 2 | EG | Ni | 5.0 | ethylenediamine | 30 | $SCN^-$ | 0.03 | 20 | 7.5 | 18 | ++ |
| Example 3 | EG | Ni | 5.0 | ethylenediamine | 30 | $SCN^-$ | 0.07 | 20 | 7.5 | 16 | ++ |
| Example 4 | GI | Co | 0.7 | ammonia | 5 | $NO_2^-$ | 1.0 | 60 | 9.5 | 15 | ++ |
| Example 5 | Zn—Ni | Ni | 2.0 | diethylenetriamine | 7 | $H_2PO_2^-$ | 1.0 | 40 | 7.0 | 14 | ++ |
| | | Co | 2.0 | alanine | 2 | $SC(NH_2)_2$ | 2.0 | | | | |
| Example 6 | Zn—Ni | Ni | 5.0 | triethylenetramine | 10 | $ClO_4^-$ | 2.0 | 30 | 6.5 | 15 | ++ |
| | | | | aspartic acid | 2 | $PO_3^{3-}$ | 1.0 | | | | |
| Example 7 | EG | Co | 6.0 | trimethylenediamine | 10 | $NO_3^-$ | 1.0 | 30 | 8.0 | 16 | ++ |
| | | | | glutamic acid | 2 | $CO_3^{2-}$ | 0.5 | | | | |
| Example 8 | Zn—Ni | Ni | 3.0 | ammonia | 10 | — | — | 20 | 5.5 | 18 | ++ |
| | | | | glycine | 10 | | | | | | |
| Example 9 | EG | Ni | 10 | ammonia | 30 | $NO_2^-$ | 2.0 | 5 | 10.0 | 16 | ++ |
| | | | | N-methylethylenediamine | 5 | $S_2O_3^{2-}$ | 0.5 | | | | |
| Comparison Example 1 | GI | Co | 0.3 | ammonia | 5 | $NO_2^-$ | 1.0 | 60 | 9.5 | 25 | ++ |
| Comparison Example 2 | EG | Ni | 10 | ammonia | 30 | $NO_2^-$ | 2.0 | 2 | 10.0 | 22 | ++ |
| | | | | N-methylethylenediamine | 5 | $S_2O_3^{2-}$ | 0.5 | | | | |
| Comparison Example 3 | EG | Cu | 10 | — | — | potassium chlorate | 20 | 2 | 3.0 | 12 | x |
| | | Ni | 5.0 | | | | | | | | |
| Comparison Example 4 | EG | Ni | 2.0 | sodium glyconate | 5 | — | — | 20 | 11.5 | 35 | ++ |

EG: 20 g/m$^2$ electrogalvanization
Zn—Ni: 20 g/m$^2$ zinc-nickel alloy electroplating
GI: 90 g/m$^2$ melt galvanization Benefits of the Invention The present invention achieves an excellent corrosion resistance and adherence through the use of a one-step treatment solution with pH 5, and is highly advantageous in terms of bath management, operations, and cost. In particular, there are fewer restrictions on the treatment container since the treatment solution has a pH of at least 5.0.

Another benefit of the present invention is that the rate of blackening can be readily increased by the addition of a displacement ligand (nitrite ion, nitrate ion, carbonate ion, and the like) to the treatment solution; this allows a reduction in treatment time and temperature.

What is claimed is:

1. A process for forming a blackened layer on a zinciferous surface by contact the zinciferous surface with an aqueous liquid solution composition that has a pH of at least 5 and consists essentially of water and the following components:

(A) at least 0.5 g/L of the treatment solution of ions selected from the group consisting of $Ni^{2+}$, $Co^{2+}$, and mixtures thereof; and (B) an amount, stoichiometrically sufficient to complex all the ions of component (A), of a weak complexing component selected from the group consisting of ammonia, saturated aliphatic compounds having at least two amino groups of which at least one is a primary amino group, amino acids, and mixtures of any two or more of these; and (C) a component selected from the group consisting of nitrite ions, nitrate ions, perchlorate ions, and mixtures of any two or more of these in an amount effective to accelerate the rate of dissolution of zinc in contact with the composition; and, optionally, (D) a component selected from the group consisting of carbonate ions, thiocyanate ions, thiosulfate ions, thiourea, hypophosphite ions, phosphite ions, and mixtures of any two or more of these.

2. A process according to claim 1, wherein the total of components () and (D) in said aqueous solution composition constitutes at least 50 parts per million ("ppm") by weight, referred to the total solution composition.

3. A process according to claim 2, wherein a total amount of nickel and cobalt within the range from about 80 to about 200 $mg/m^2$ of the zinciferous surface contacted is deposited on the surface during the process.

4. A process according to claim 1, wherein a total amount of nickel and cobalt within the range from about 80 to about 200 $mg/m^2$ of the zinciferous surface contacted is deposited on the surface during the process.

5. A process according to claim 4, wherein the time of contacting between said zinciferous surface and said aqueous solution composition is between about 3 and about 120 seconds.

6. A process according to claim 3, wherein the time of contacting between said zinciferous surface and said aqueous solution composition is between about 3 and about 120 seconds.

7. A process according to claim 2, wherein the time of contacting between said zinciferous surface and said aqueous solution composition is between about 3 and about 120 seconds.

8. A process according to claim 1, wherein the time of contacting between said zinciferous surface and said aqueous solution composition is between about 3 and about 120 seconds.

9. A process according to claim 8, wherein the temperature during contacting between said zinciferous surface and said aqueous solution composition is between about 20 and about 80 degrees Centigrade.

10. A process according to claim 7, wherein the temperature during contacting between said zinciferous surface and said aqueous solution composition is between about 20 and about 80 degrees Centigrade.

11. A process according to claim 6, wherein the temperature during contacting between said zinciferous surface and said aqueous solution composition is between about 20 and about 80 degrees Centigrade.

12. A process according to claim 5, wherein the temperature during contacting between said zinciferous surface and said aqueous solution composition is between about 20 and about 80 degrees Centigrade.

13. A process according to claim 4, wherein the temperature during contacting between said zinciferous surface and said aqueous solution composition is between about 20 and about 80 degrees Centigrade.

14. A process according to claim 3, wherein the temperature during contacting between said zinciferous surface and said aqueous solution composition is between about 20 and about 80 degrees Centigrade.

15. A process according to claim 2, wherein the temperature during contacting between said zinciferous surface and said aqueous solution composition is between about 20 and about 80 degrees Centigrade.

16. A process according to claim 1, wherein the temperature during contacting between said zinciferous surface and said aqueous solution composition is between about 20 and about 80 degrees Centigrade.

17. A process according to claim 1, wherein the contacting is accomplished by immersion, spraying, or roll coating.

18. A process according to claim 2, wherein the contacting is accomplished by immersion, spraying, or roll coating.

19. A process according to claim 3, wherein the contacting is accomplished by immersion, spraying, or roll coating.

20. A process according to claim 4, wherein the contacting is accomplished by immersion, spraying, or roll coating.

* * * * *